US007954606B2

(12) United States Patent
Tinone et al.

(10) Patent No.: US 7,954,606 B2
(45) Date of Patent: Jun. 7, 2011

(54) ELEVATOR SYSTEM CONTROL RESPONSIVE TO HOISTWAY ACCESS DETECTION

(75) Inventors: Helio Tinone, West Hartford, CT (US); Anthony Black, South Windsor, CT (US); Nora E. LaFreniere, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 630 days.

(21) Appl. No.: 12/067,940

(22) PCT Filed: Oct. 5, 2005

(86) PCT No.: PCT/US2005/035740

§ 371 (c)(1),
(2), (4) Date: Mar. 25, 2008

(87) PCT Pub. No.: WO2007/040538

PCT Pub. Date: Apr. 12, 2007

(65) Prior Publication Data

US 2008/0223667 A1 Sep. 18, 2008

(51) Int. Cl.
*B66B 1/20* (2006.01)

(52) U.S. Cl. ..... 187/384; 187/391

(58) Field of Classification Search ..... 187/391–393, 187/380–388

See application file for complete search history.

(56) References Cited

U.S. PATENT DOCUMENTS

| | | | | |
|---|---|---|---|---|
| 5,347,094 | A * | 9/1994 | Leone et al. | 187/390 |
| 5,476,157 | A * | 12/1995 | Todaro | 187/280 |
| 5,644,111 | A * | 7/1997 | Cerny et al. | 187/393 |
| 6,050,369 | A * | 4/2000 | Leone et al. | 187/392 |
| 6,138,798 | A * | 10/2000 | Macuga | 187/294 |
| 6,202,797 | B1 * | 3/2001 | Skolnick et al. | 187/317 |
| 6,223,861 | B1 | 5/2001 | Sansevero | |
| 6,550,585 | B2 | 4/2003 | Schoppa et al. | |
| 6,603,398 | B2 * | 8/2003 | Tinone et al. | 340/541 |
| 6,615,953 | B1 | 9/2003 | Steinweg | |
| 6,630,886 | B2 * | 10/2003 | Malone, Jr. | 340/540 |
| 7,201,256 | B2 * | 4/2007 | Deplazes et al. | 187/300 |
| 7,448,473 | B2 * | 11/2008 | Lindberg et al. | 187/392 |
| 2004/0173414 | A1 | 9/2004 | Deplazes et al. | |

FOREIGN PATENT DOCUMENTS

| | | |
|---|---|---|
| JP | 7267530 A | 10/1995 |
| JP | 930747 | 2/1997 |

OTHER PUBLICATIONS

International Search Report and Written Opinion of the International Searching Authority for International application No. PCT/US05/35740 mailed Nov. 14, 2006.

* cited by examiner

*Primary Examiner* — Jonathan Salata
(74) *Attorney, Agent, or Firm* — Carlson, Gaskey & Olds PC

(57) ABSTRACT

An elevator system (20) includes a sensor (30, 36) for detecting the presence of an individual within a hoistway (24). A controller (32) prevents movement of an elevator car (22) whenever an individual is in the hoistway (24). A pit override device (34) provides an override signal to the controller (32) permitting movement of the elevator car (22) if someone is in a pit (26). A car top override device (38) selectively provides an override signal to the controller (32) permitting movement of the car. A disclosed example includes controlling at least one light (40) within the hoistway (24) in conjunction with movement or attempted movement of the elevator car (22).

18 Claims, 1 Drawing Sheet

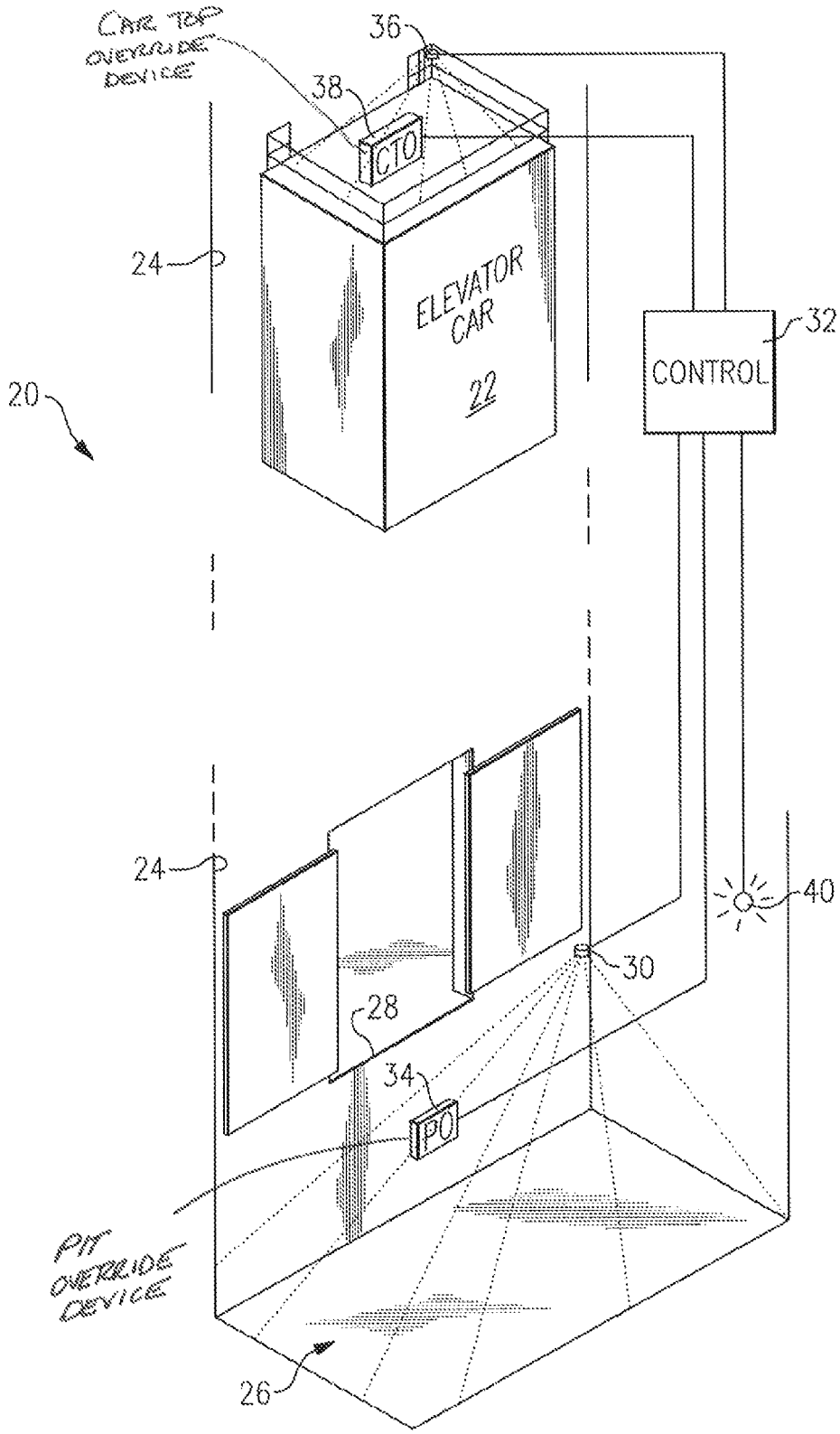
CAR TOP OVERRIDE DEVICE
36
38
CTO
24
ELEVATOR CAR
22
CONTROL
32
20
24
40
30
28
34
PO
PIT OVERRIDE DEVICE
26

ELEVATOR SYSTEM CONTROL RESPONSIVE TO HOISTWAY ACCESS DETECTION

FIELD OF THE INVENTION

This invention generally relates to elevator systems. More particularly, this invention relates to an arrangement for controlling movement of an elevator car responsive to detecting the presence of an individual within a hoistway.

DESCRIPTION OF THE RELATED ART

Elevator systems typically provide for inspection mode operation to allow maintenance personnel to conduct maintenance or repair procedures. Most maintenance procedures involve an individual on top of an elevator car for at least some of the maintenance procedure. The pit near the bottom of a hoistway is another location where a technician may be during one or more portions of a maintenance or repair procedure.

There are a variety of known systems for protecting individuals during such procedures. For example, U.S. Pat. No. 6,550,585 discloses sensors on top of an elevator car and in an elevator pit for detecting the presence of an individual in either of those locations. Other example arrangements are shown in U.S. Pat. No. 6,223,861 and the published application WO 03/008316.

Even with such arrangements, those skilled in the art are always striving to make improvements. This invention provides enhanced features for controlling operation of an elevator system when an individual is within the hoistway.

SUMMARY OF THE INVENTION

An exemplary disclosed elevator safety system includes a sensor for detecting the presence of an individual in a hoistway. An override device provides an override signal responsive to manual activation by an individual in the hoistway. A controller communicates with the sensor and the override device. The controller prevents movement of an associated elevator car if the sensor indicates the presence of an individual and the override device does not provide the override signal. The controller in one example enables movement of the elevator car responsive to the override signal.

With such an arrangement, whenever someone is present in the hoistway, the elevator car cannot be moved unless the individual takes some action to provide authorization for such movement. In one example, the only movement allowed when an individual is in the hoistway is an inspection mode of elevator car movement, which typically includes slower car speeds than normal operation, for example.

One example includes a pit sensor and a pit override device near a bottom of a hoistway. Another example includes a car top sensor for detecting the presence of an individual on top of the elevator car and a car override device on top of the elevator car. The controller in such an example prevents movement of the elevator car if the sensor indicates the presence of an individual and the corresponding override device does not provide the override signal. In one example, the controller enables movement of the elevator car responsive to the override signal.

One disclosed example includes at least one light for at least partially illuminating the hoistway. The controller at least temporarily alters the appearance or intensity of the light if there is an attempt to move the elevator car when the sensor indicates the presence of an individual in the hoistway. Controlling the light in this manner provides an alert to the individual in the hoistway regarding potential car movement. In one example, controlling the light in this manner prompts the individual in the hoistway to provide the override signal authorizing movement of the elevator car in the event that the individual has not previously activated the override device.

The various features and advantages of this invention will become apparent to those skilled in the art from the following detailed description. The drawing that accompanies the detailed description can be briefly described as follows.

BRIEF DESCRIPTION OF THE DRAWING

FIG. 1 schematically illustrates selected portions of an elevator system designed according to an embodiment of this invention.

DETAILED DESCRIPTION OF THE PREFERRED EMBODIMENT

FIG. 1 schematically shows selected portions of an elevator system 20. An elevator car 22 is moveable within a hoistway 24 in a known manner. The hoistway 24 includes a pit 26 near a bottom of the hoistway. A lowest landing 28 of the associated building is schematically shown in FIG. 1 and a floor of the pit 26 is below that lowest landing as known.

The example system includes at least one sensor for detecting the presence of an individual in the hoistway. This example includes a pit sensor 30 for detecting the presence of an individual within the pit 26. A variety of known sensors may be used to detect the presence of an individual in the pit 26. One example includes a pyroelectric sensor. Another example includes an infrared sensor. Another example includes an ultrasound sensor. One example pit sensor comprises video equipment. Still another example includes a pressure sensitive mat or switch associated with the floor of the hoistway pit 26. Those skilled in the art who have the benefit of this description will be able to choose appropriate components for their situation.

Regardless of the form of the pit sensor, it communicates with a controller 32 to provide an indication of when an individual is in the pit 26. The controller 32 responds to an indication from the pit sensor 30 regarding the presence of an individual in the pit 26 by preventing movement of the elevator car 22. In one example, the controller 32 is operative to disable an elevator drive (not illustrated) or apply a brake (not illustrated) so that the car 22 cannot be moved.

In one example, whenever the sensor indicates the presence of an individual in the hoistway, the controller 32 will not allow the car 22 to move unless an appropriate override signal is provided to the controller. The individual in the hoistway takes some action to provide such a signal to authorize car movement. The illustrated example includes a pit override device 34 that can be manually activated by an individual in the pit 26. One example includes a switch that is manually manipulated by the individual. The pit override device 34 provides a pit override signal to the controller 32 indicating that the individual in the pit authorizes or accepts movement of the elevator car 22. In one example, the controller 32 enables movement of the elevator car 22 responsive to the pit override signal but only allows an inspection mode of car movement as long as an individual is in the pit 26. An inspection mode of car movement may include, for example, a limited range of movement, a slower speed of movement compared to a normal operating speed, or both.

The illustrated example provides enhanced safety to an individual in the pit 26 while still allowing desirable movement of the car 22 for inspection or maintenance procedures. The controller 32 prevents movement of the car 22 unless the individual in the pit 26 utilizes the pit override device 34 to provide a signal indicating that it is acceptable to allow car movement (e.g., the individual is in a safe position or is at least aware of the car movement to avoid any undesirable contact with moving parts within the hoistway).

In one example, a standard pit emergency stop switch (not illustrated) in the pit 26 must be utilized in a known manner by the individual in the pit 26. In this example, a proper combination of activations of the pit override device 34 and the pit emergency stop switch allows inspection mode movement while the individual is in the pit.

The sensor for detecting the presence of an individual in the hoistway in the example of FIG. 1 also includes a car top sensor 36 for detecting the present of an individual on top of the car 22. The car top sensor 36 in one example is similar to the pit sensor 30. Those skilled in the art who have the benefit of this description will be able to select from among known devices to realize a car top sensor that meets their particular needs.

The controller 32 in one example prevents movement of the elevator car 22 whenever the car top sensor 36 provides an indication that an individual is on top of the car 22. The illustrated example includes a car top override device 38 that is manually activatable by an individual to provide a car top override signal to the controller 32. The car top override signal provides authorization to the controller 32 to allow movement of the elevator car even though an individual is on top of the car 22.

In one example, the car top override device 38 is incorporated into a device that also includes the car top inspection switches used for initiating an inspection mode and selecting movement of the car 22, for example. In another example, the car top override device 38 is in a separate location to prompt conscious activation of the car top override device 38 by the individual on the car.

In one example, the controller 32 will not allow movement of the elevator car 22 whenever an individual is present on top of the car 22 or in the pit 26 as indicated by either of the sensors 30 or 36. Wherever an individual is present, a corresponding override signal is required by the controller 32 before allowing any movement of the elevator car 22.

Another feature of the example embodiment is that at least one light 40 is positioned to at least partially illuminate the hoistway 24. Although one light 40 is shown, multiple lights in a hoistway may be useful in some situations. In one example, whenever an individual (typically on top of the elevator car 22) attempts to move the car 22 during an inspection procedure, the controller 32 determines whether an override signal from the appropriate override device is required because the sensor indicates that an individual is present within the hoistway 24. If the appropriate pit override device 34 or 38 has not been activated, the controller 32 alters operation of the light 40 to provide a visual prompting indicating a need for the override signal from the individual in the hoistway. In one example, the controller 32 at least temporarily dims the light 40, which will prompt the individual to take some action. Dimming the light 40 in one example includes turning off the light for a selected period of time. Another example includes flashing the light 40 for at least a selected time. In one example, the controller 32 dims the light 40 until it receives an appropriate override signal.

One advantage to the disclosed example light control feature is that it simulates or facilitates communication between an individual on top of the elevator car 22 and another individual in the pit 26. When the individual on top of the car 22 desires to move the car 22 and a pit override signal is required, automatically controlling operation of the light 40 prompts the individual in the pit 26 to provide the appropriate pit override signal. This eliminates a need for the individual on top of the car to get the attention of the person in the pit in some other way.

In one example, the controller 32 controls operation of one or more lights 40 whenever an individual attempts to move the elevator car 22 and either of the sensors 30 or 36 indicates that an individual is present in a corresponding location. Such control over the lighting in a hoistway provides a prompting for the appropriate override signal as mentioned above. In one example, even if all appropriate, required override signals have been received by the controller 32, the controller 32 operates the light 40 to at least provide a visible indication that the car 22 is about to move.

In one example, another light is associated with the pit override device 34 and the controller 32 controls that light to turn it on at least during the time when the light 40 is dimmed or turned off. In one example, a portion of the pit override device 34 is illuminated when the light 40 is dimmed to provide a visible indication of the pit override device 34 to assist the individual in providing the required override signal, from the pit for example. Illumination of the pit override device in conjunction with control of the light 40 provides further visible prompting to the individual in the pit 26 to provide the required override signal.

One example includes lighting a pit emergency stop switch, also, to provide a visible prompting to the individual in the pit regarding its location and a need to activate it.

As can be appreciated, the disclosed example arrangement provides several enhancements to arrangements for controlling elevator car movement and protecting an individual within a hoistway during a maintenance or repair procedure, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator safety system, comprising:

a sensor for detecting the presence of an individual in a hoistway;

an override device that provides an override signal responsive to manual activation by the individual in the hoistway; and a controller that communicates with the sensor and the override device, the controller prevents movement of an associated elevator car if the sensor indicates the presence of all individual and the override device does not provide the override signal.

2. The system of claim 1 wherein the controller enables movement of the elevator car in an inspection mode or a maintenance mode responsive to the override signal.

3. The system of claim 1, wherein the sensor includes a pit sensor for detecting the presence of an individual in a pit area of the hoistway and the override device includes a pit override device that provides a pit override signal responsive to manual activation by the individual in the pit and the controller prevents movement of the elevator car if the pit sensor indicates the presence of an individual and the pit override device does not provide the pit override signal.

4. The system of claim 1, wherein the sensor includes a car top sensor for detecting the presence of an individual on top of the elevator car and the override device include a car override device that provides a car top override signal responsive to manual activation by an individual on top of the elevator car and wherein the controller prevents movement of the elevator car if the car top sensor indicates the presence of an individual and the car override device does not provide the car top override signal.

5. The system of claim 4, wherein the controller prevents a normal, passenger service operation mode of movement of the elevator car if the sensor indicates the presence of an individual.

6. The system of claim 1, including a light for at least partially illuminating the hoistway and wherein the controller at least temporarily alters an appearance or intensity of the light if there is an attempt to move the elevator car when the sensor indicates the presence of an individual in the hoistway.

7. The system of claim 6, wherein the controller at least temporarily changes an operation of the light responsive to a subsequent receipt of the override signal.

8. The system of claim 6, comprising a second light for illuminating at least a portion of the override device and wherein the controller selectively controls the second light.

9. A method of controlling movement of an elevator car within a hoistway, comprising the steps of:

determining whether there is an individual in the hoistway; and preventing movement of the elevator car if an individual is in the hoistway unless the individual manually activates an override device while the individual is in the hoistway to provide an override signal for permitting movement of the elevator car.

10. The method of claim 9, comprising allowing movement of the elevator car in an inspection mode or a maintenance mode responsive to the override signal.

11. The method of claim 9, comprising:

determining whether an individual is present in a pit area near a bottom of the hoistway and;

preventing movement of the elevator car if an individual is in the pit area unless the individual provides a pit override signal permitting movement or the elevator car.

12. The method of claim 9, comprising:

determining whether an individual is present on top of the elevator car; and preventing movement of the elevator car if an individual is on top of the elevator car unless the individual provides a car top override signal permitting movement of the elevator ear.

13. The method of claim 9, comprising preventing a normal operation mode of movement of the elevator ear if there is an individual in the hoistway.

14. The method of claim 9, comprising at least temporarily altering the appearance or intensity of a light if there is an attempt to move the elevator car when there is an individual in the hoistway.

15. The method of claim 14, comprising at least temporarily changing an operation of the light responsive a subsequent receipt of the override signal.

16. The method of claim 14, comprising illuminating at least a portion of a device for providing the override signal.

17. The method of claim 9, wherein the override device is at the location of the individual in the hoistway.

18. The system of claim 1, wherein the override device is at the location of the individual in the hoistway.

* * * * *